US006009778A

United States Patent [19]

Hsieh

[11] Patent Number: 6,009,778

[45] Date of Patent: Jan. 4, 2000

[54] STRUCTURE OF OPEN END WRENCH

[76] Inventor: Chih-Ching Hsieh, No. 64, Lane 107, Liang Tsun Rd., Fong Yuan City, Taichung Hsien, Taiwan

[21] Appl. No.: 09/012,228

[22] Filed: Jan. 23, 1998

[51] Int. Cl.[7] ..... B25B 13/02

[52] U.S. Cl. ..... 81/119; 81/186

[58] Field of Search ..... 81/119, 120, 186

[56] References Cited

U.S. PATENT DOCUMENTS

| | | | |
|---|---|---|---|
| 463,137 | 11/1891 | Carpenter | 81/186 |
| 529,707 | 11/1894 | Clay | 81/119 |
| 720,554 | 2/1903 | Benesh | 81/120 |
| 1,479,772 | 1/1924 | Cook | 81/119 |
| 5,860,339 | 1/1999 | Mikic et al. | 81/186 |

*Primary Examiner*—David A. Scherbel
*Assistant Examiner*—Joni B. Danganan
*Attorney, Agent, or Firm*—Varndell & Varndell, PLLC

[57] ABSTRACT

An open end wrench having a mouth defined between two jaws and a nest thereof, and a flat raised portion and a longitudinal series of teeth respectively raised from the two jaws inside the mouth. The longitudinal series of teeth including seven teeth, the center of the raised portion is aligned with the center of the mouth and the middle tooth of the longitudinal series of teeth. The line between the front end of the raised portion and the second tooth of the longitudinal series of teeth is parallel to the line between the rear end of the raised portion and the second to last tooth of the longitudinal series of teeth. The longitudinal length of the longitudinal series of teeth being 0.56 of the width of the mouth, and the distance from the front end of the longitudinal series of teeth to the nest being 0.89 of the width of the mouth.

1 Claim, 11 Drawing Sheets

STRUCTURE OF OPEN END WRENCH

BACKGROUND AND SUMMARY OF THE INVENTION

The present invention relates to open end wrenches, and more particularly to an improved structure of an open end wrench which is practial for grasping and turning normal bolts and nuts of different specifications as well as worn-out bolts and nuts of different specifications.

An open end wrench is handy tool intensively used for grasping and turning bolts and nuts. A variety of open end wrenches have been disclosed having teeth, raised portions or rough grasping faces at the jaws for grasping and turning normal bolts and nuts as well as worn-out bolts and nuts. Exemplars of conventional open end wrenches are shown in FIGS. from 1 to 13. The open end wrench shown in FIGS. 1, 2, and 3 has two flat raised portions at the jaws. This structure of open end wrench is functional for turning normal bolts and nuts as well as slightly worn-out bolts and nuts. However, it can not positively grasp and turn excessively worn-out bolts and nuts. FIGS. 4, 5, 7,8, 9, 10 and 11 show other different designs. These designs can grasp and turn bolts and nuts of different sizes. However, these designs can not positively grasp and turn excessively worn-out bolts and nuts. FIG. 6 shows another design of open end wrench which is similar to the open end wrench shown in FIGS. 1 to 3. FIG. 12 shows an open end wrench having rough faces at the jaws. FIG. 13 shows an open end wrench having teeth at the jaws. The open end wrenches shown in FIGS. 12 and 13 can positively grasp and turn normal bolts and nuts, however they tend to slip when turning an excessively worn-out bolt or nut.

It is one object of the present invention to provide an open end wrench which is practical for grasping and turning hexagon head bolts and hexagon nuts as well as square head bolts and square nuts. It is another object of the present invention to provide an open end wrench which is practical for grasping and turning normal bolts and nuts of different specifications as well as worn-out bolts and nuts of different specifications. According to the present invention, the open end wrench comprises a mouth defined between two jaws and nest thereof, a flat raised portion and a longitudinal series of teeth respectively raised from the two jaws inside the mouth. The longitudinal series of teeth including seven teeth, and the center of the raised portion being in alignment with the center of the mouth and the middle tooth of the longitudinal series of teeth. The distance from the center of the mouth of the nest being equal to the distance from the center of the polygonal head of the polygonal head bolts to be turned to the corner of the bolts. The line between the front end of the raised portion and the second tooth of the longitudinal series of teeth being parallel to the line between the rear end of the raised portion and the second to last tooth of the longitudinal series of teeth, the longitudinal length of the longitudinal series of teeth being 0.56 of the width of the mouth, and the distance from the front end of the longitudinal series of teeth to the nest being 0.89 of the width of the mouth.

DETAILED DESCRIPTION OF THE PREFERRED EMBODIMENT

Figure 1:
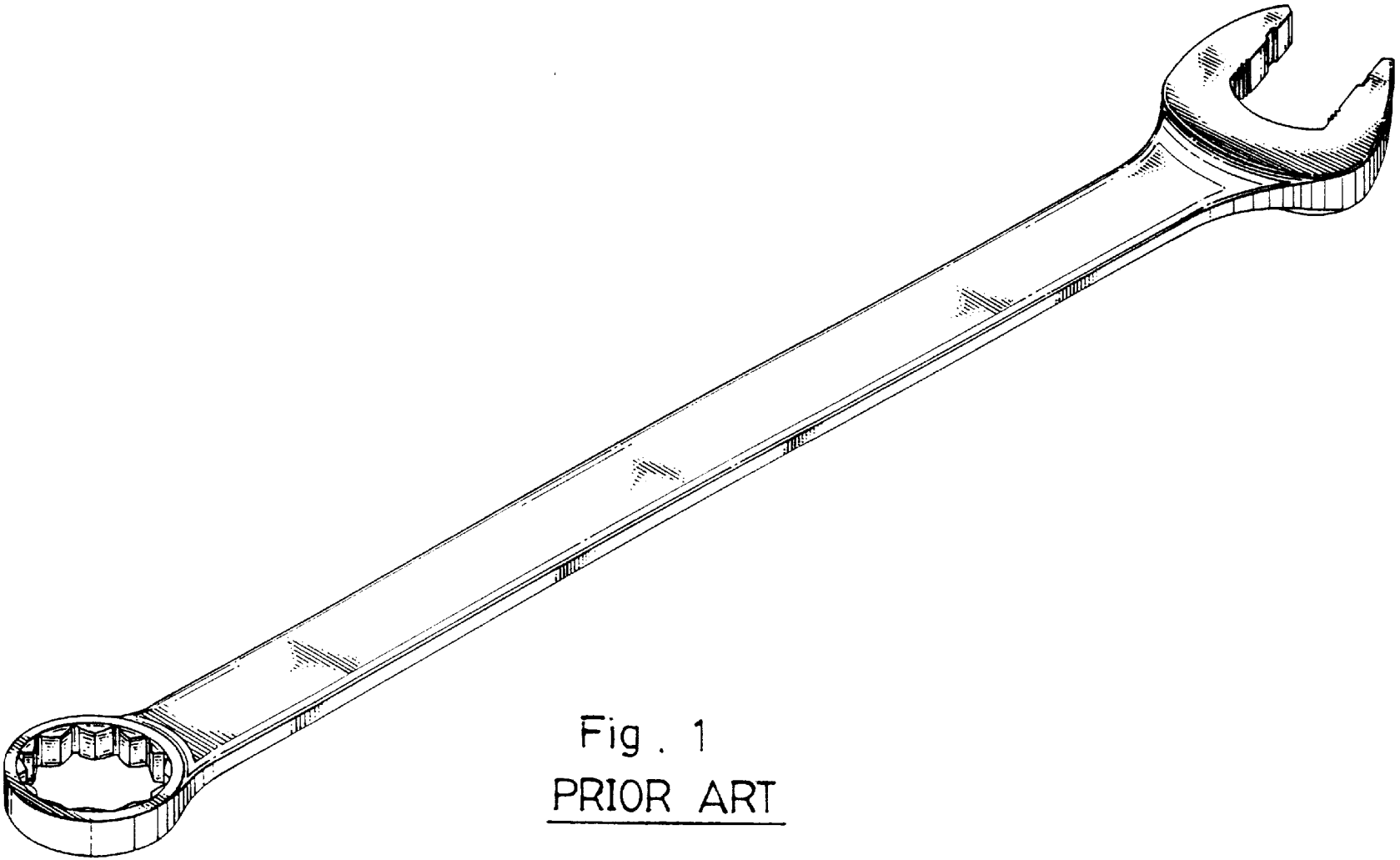
Fig. 1 PRIOR ART
FIG. 1 shows a combination wrench according to the prior art.
Figure 2:
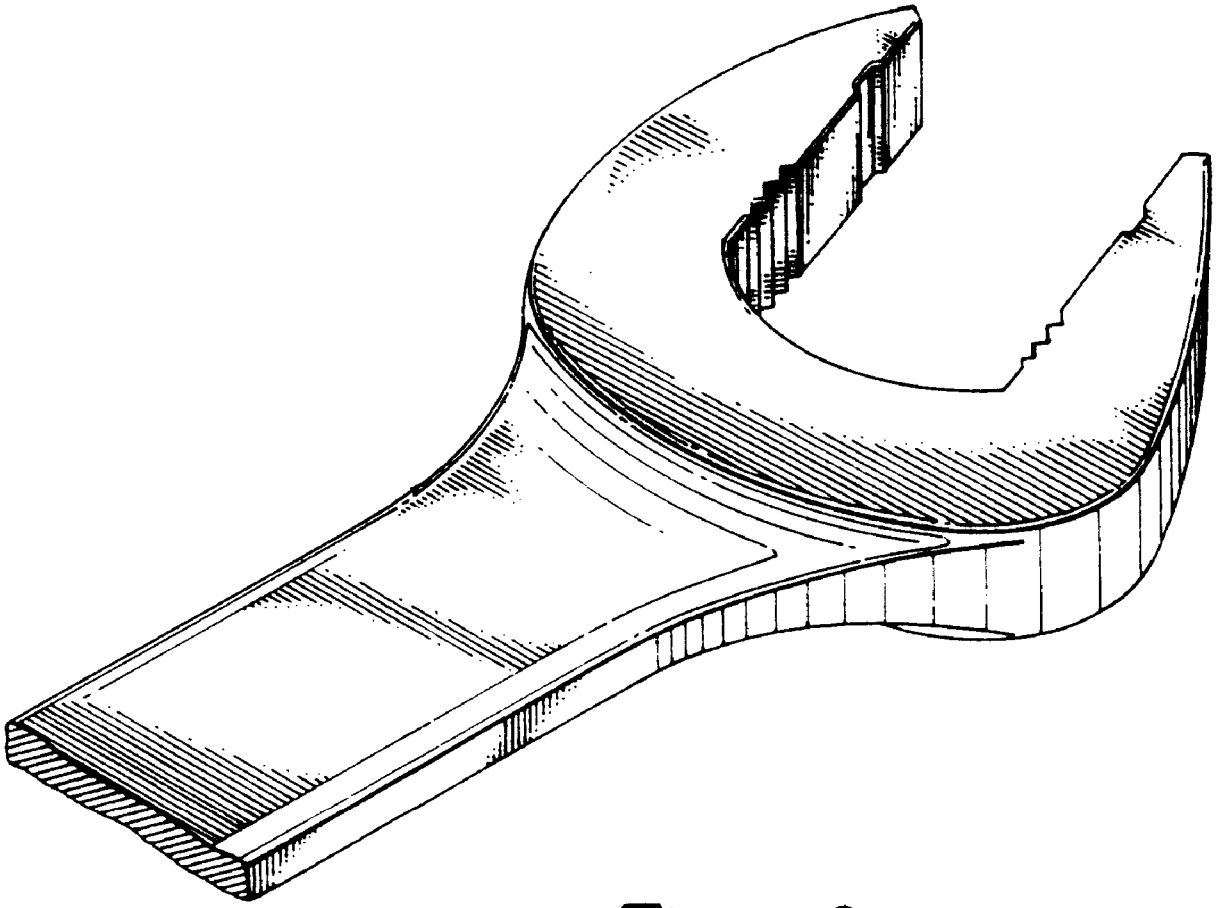
Fig. 2 PRIOR ART
FIG. 2 is an enlarged view of the open end of the combination wrench shown in FIG. 1.
Figure 4:
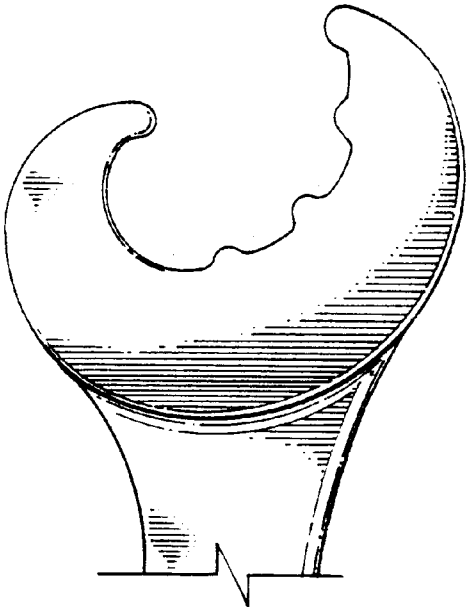
Fig. 4 PRIOR ART
FIG. 4 shows another structure of open end wrench according to the prior art.
Figure 3:
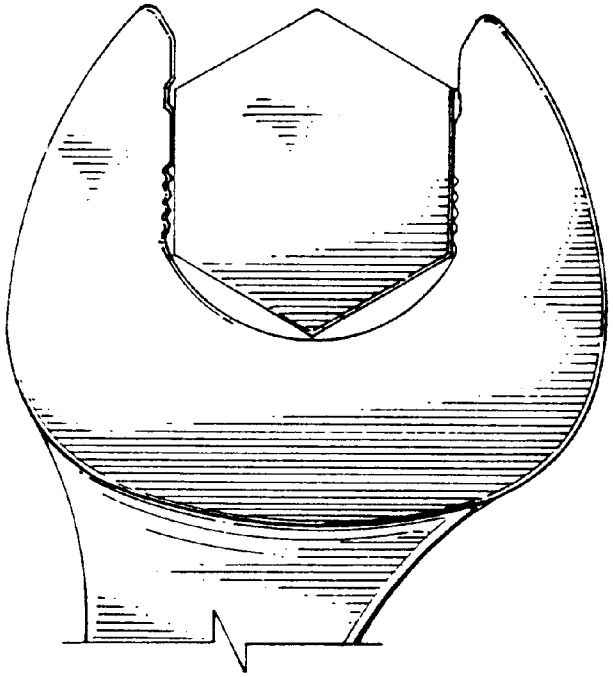
Fig. 3 PRIOR ART
FIG. 3 shows an application example of the open end of the combination wrench shown in FIG. 1.
Figure 6:
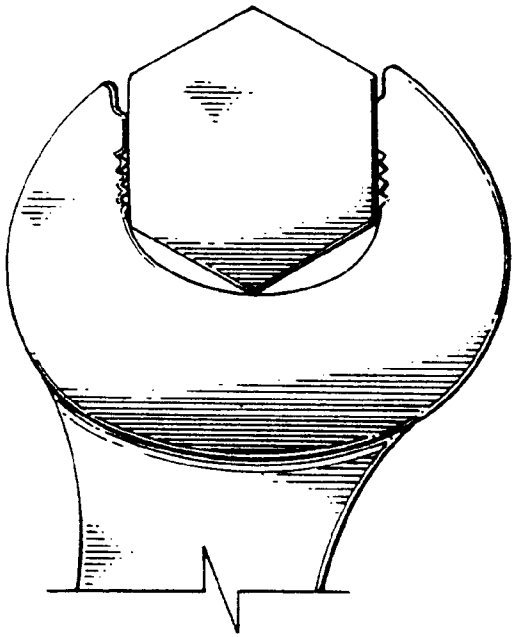
Fig. 6 PRIOR ART
FIG. 6 shows still another structure of open end wrench according to the prior art.
Figure 5:
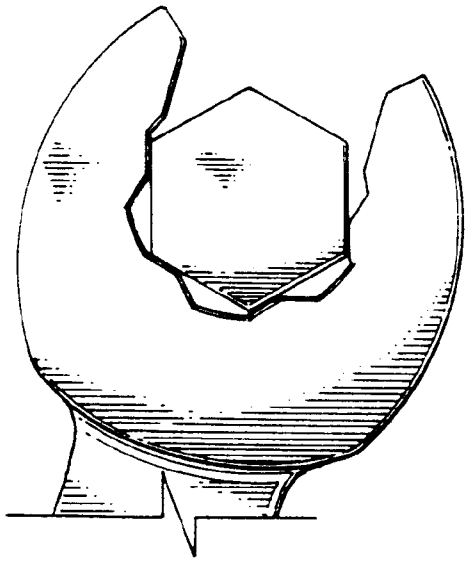
Fig. 5 PRIOR ART
FIG. 5 shows still another structure of open end wrench according to the prior art.
Figure 8:
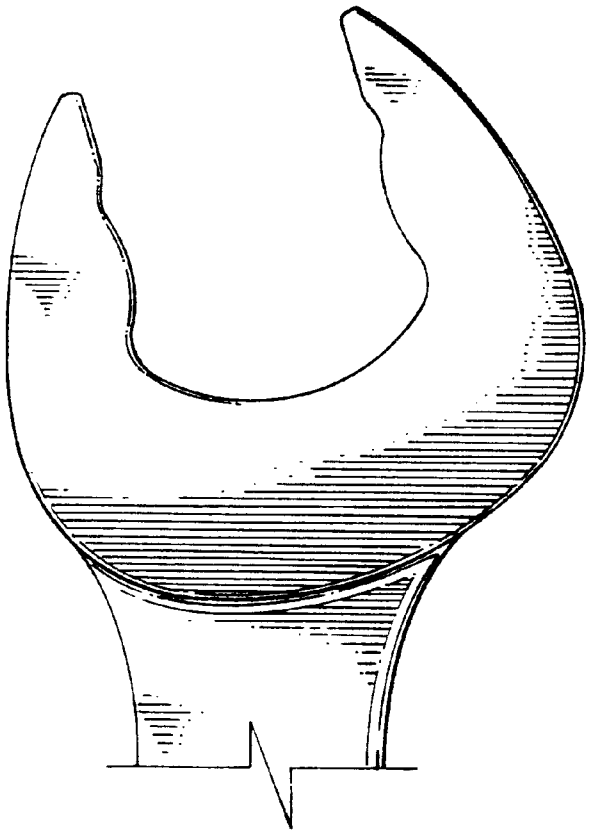
Fig. 8 PRIOR ART
FIG. 8 shows still another structure of open end wrench according to the prior art.
Figure 7:
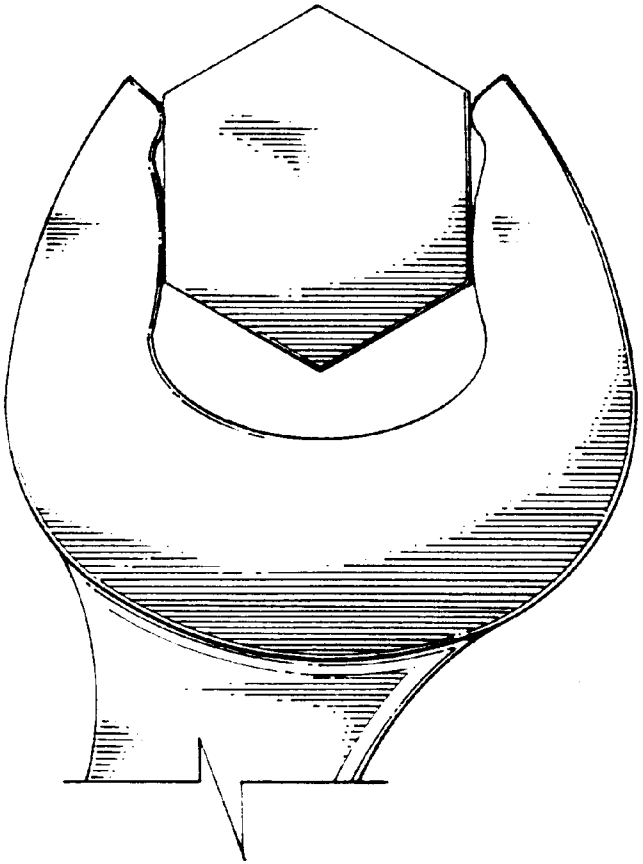
Fig. 7 PRIOR ART
FIG. 7 shows still another structure of open end wrench according to the prior art.
Figure 10:
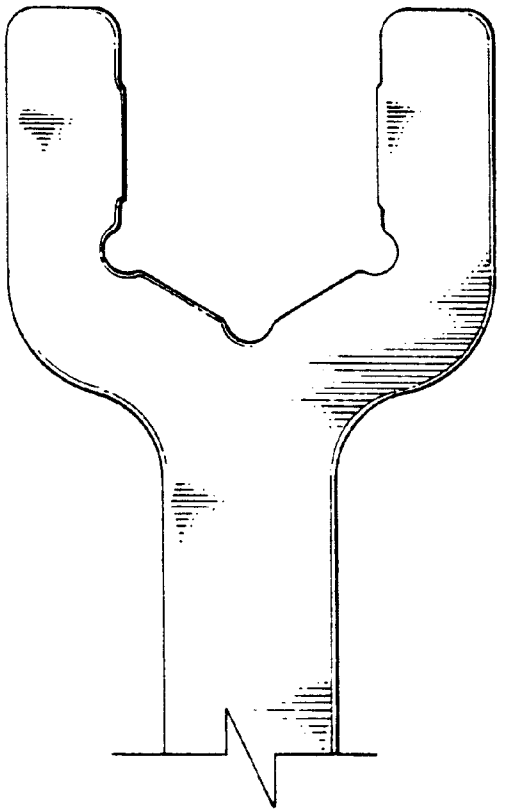
Fig. 10 PRIOR ART
FIG. 10 shows still another structure of open end wrench according to the prior art.
Figure 9:
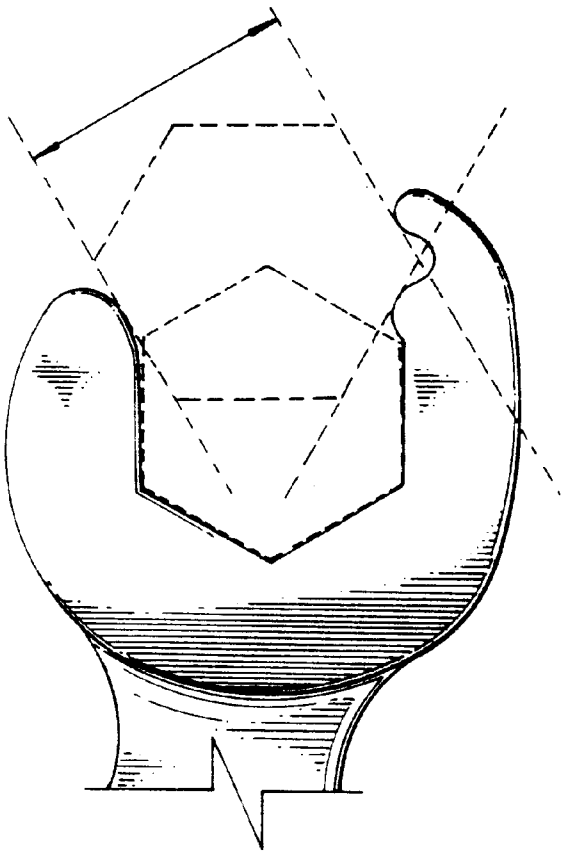
Fig. 9 PRIOR ART
FIG. 9 shows still another structure of open end wrench designed for turning bolts and nuts of different specifications according to the prior art.
Figure 11:
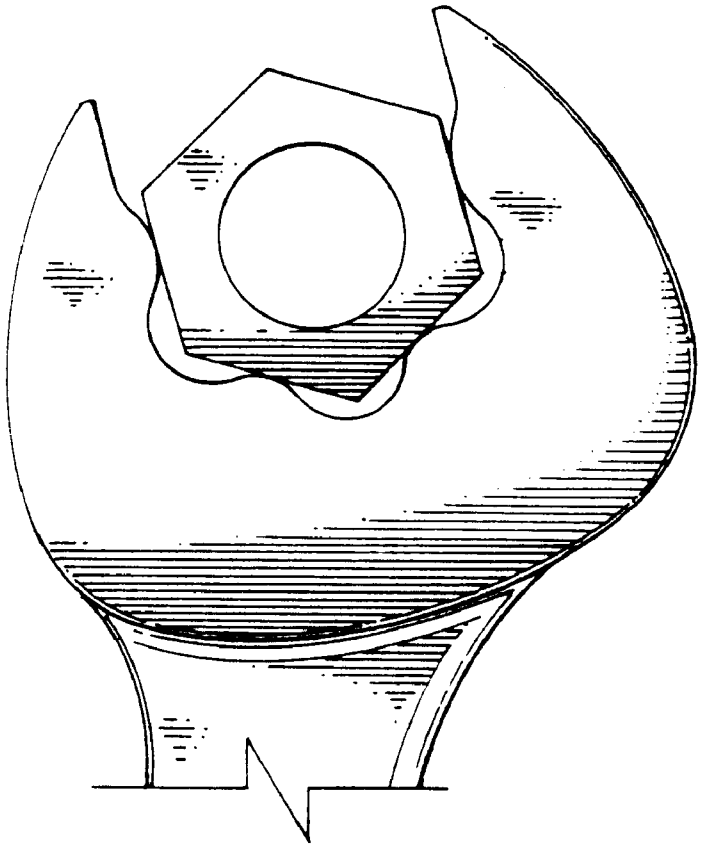
Fig. 11 PRIOR ART
FIG. 11 shows still another structure of open end wrench designed for turning bolts and nuts of different specifications according to the prior art.
Figure 13:
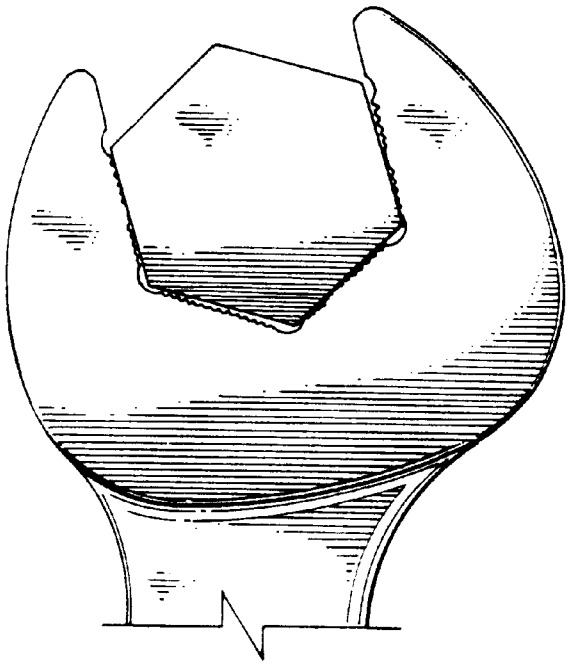
Fig. 13 PRIOR ART
FIG. 13 shows still another structure of open end wrench according to the prior art where the jaws have a respective longitudinal row of teeth at an inner side for grasping.
Figure 12:
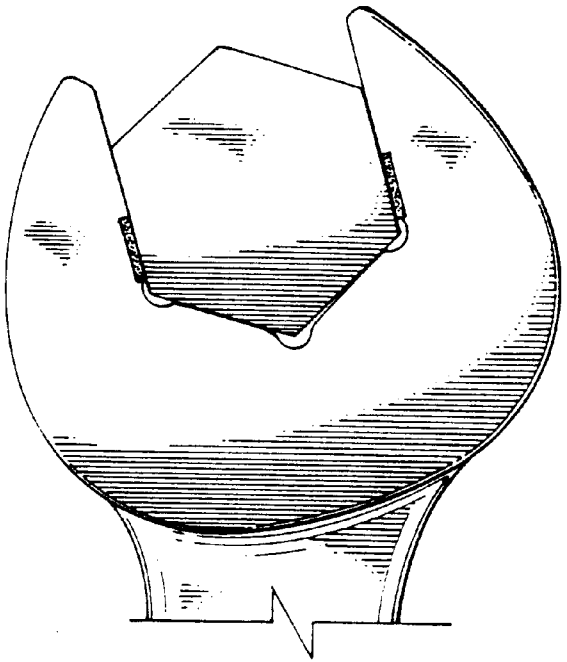
Fig. 12 PRIOR ART
FIG. 12 shows still another structure of open end wrench according to the prior art where the jaws have a respective rough grasping face at an inner side.
Figure 14:
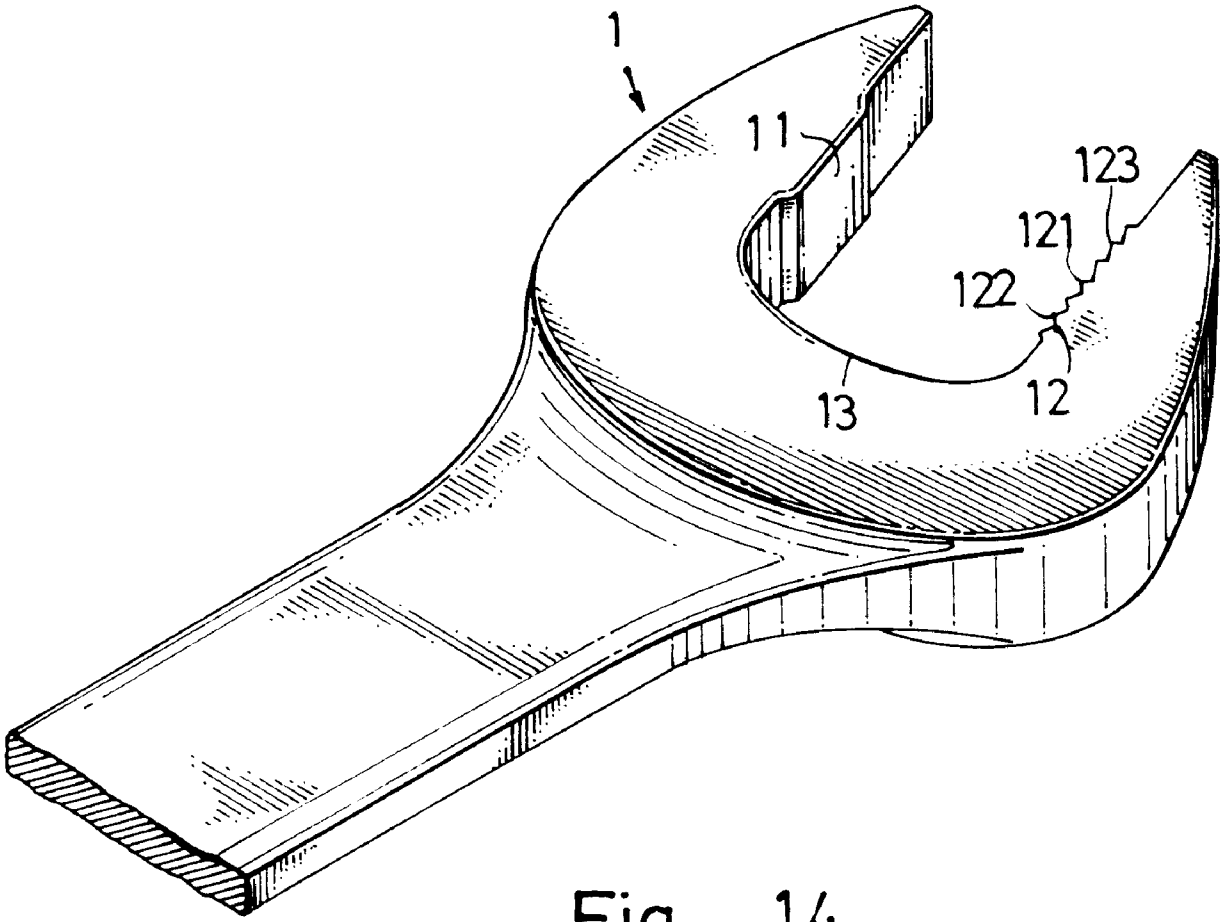
FIG. 14 is a perspective view of an open end wrench according to the present invention.
Figure 15:
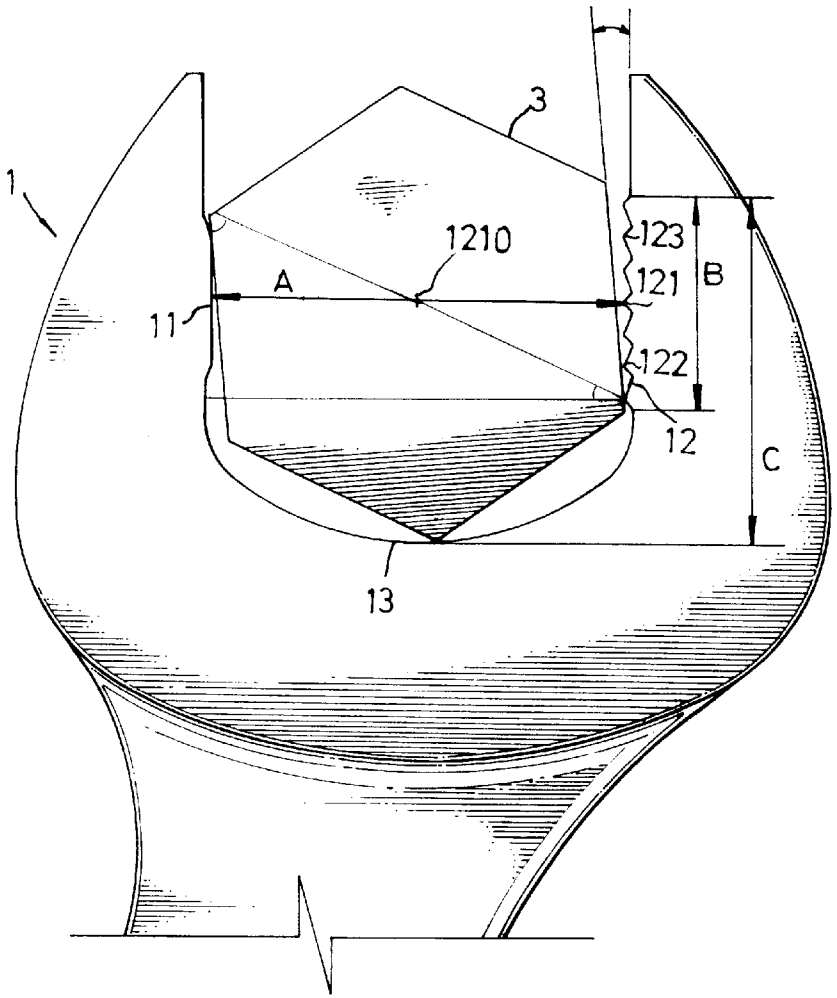
FIG. 15 is a front view in an enlarged scale of the open end wrench according to the present invention.
Figure 16:
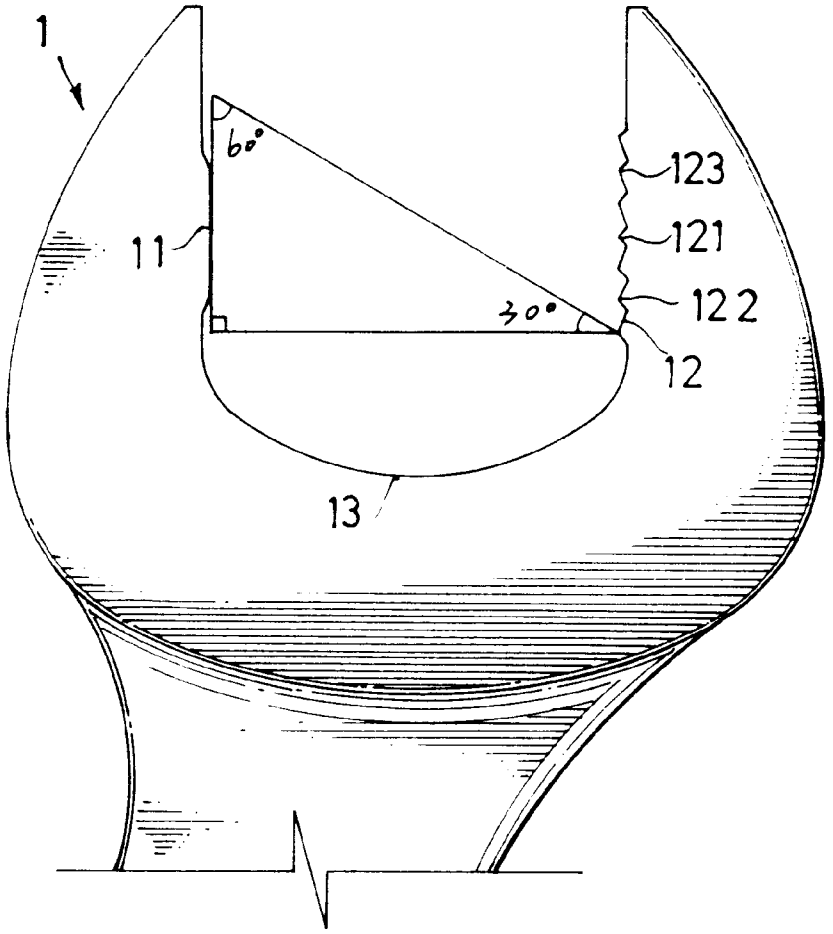
FIG. 16 is a schematic drawing explaining the design of the open end wrench according to the present invention.

An open end of an open end wrench according to the present invention is similar to regular open end wrenches, comprising two jaws, a nest connected between the jaws, and a mouth defined within the jaws and the nest and adapted for grasping and turning bolts, nuts, etc.

Referring to FIGS. from 14 to 16, the open end comprises a flat raised portion 11 and a longitudinal series of teeth 12 respectively raised from the jaws inside the mouth. The number of the longitudinal series of teeth 12 is seven. The center of the raised portion 11 is in alignment with the center 1210 of the mouth and the middle tooth 121 of the longitudinal series of teeth 12. The distance from the mouth center 1210 to the nest 13 is equal to the distance from the center of the polygonal head 3 of the polygonal head bolt to be turned to the corner (or angle) thereof. The line between the front end of the raised portion 11 and the second tooth 123 of the longitudinal series of teeth 12 is parallel to the line between the rear end of the raised portion 11 and the second to last tooth 122 of the longitudinal series of teeth 12. The longitudinal length of the longitudinal series of teeth 12 is 0.56 of the width A of the mouth between the teeth. The distance C from the front end of the longitudinal series of teeth 12 to the nest 13 is 0.89 of the width A of the mouth.

I claim:

1. An open end wrench comprising two jaws, a nest connected between said jaws, and a mouth defined within said jaws and said nest for grasping and turning polygonal head bolts, wherein a flat raised portion and a longitudinal series of teeth are respectively raised from said jaws inside said mouth, said series of teeth including seven teeth and having a front end remote from said nest and a rear end adjacent to said nest, said raised portion having a front end remote from said nest and a rear end adjacent to said nest, a center of said raised portion being in alignment with a center of said mouth and a middle tooth of said longitudinal series of teeth, a line between the front end of said raised portion and a second tooth of said longitudinal series of teeth being parallel to a line between the rear end of said raised portion and a second to last tooth of said longitudinal series of teeth, the longitudinal length of said longitudinal series of teeth being 0.56 of the width of said mouth, and the distance from the front end of said longitudinal series of teeth to said nest being 0.89 of the width of said mouth.

* * * * *